US011469539B2

(12) United States Patent
Lee et al.

(10) Patent No.: US 11,469,539 B2
(45) Date of Patent: Oct. 11, 2022

(54) SEALS FOR A FLAT FLEXIBLE CONDUCTOR IN AN ELECTRICAL CONNECTOR ASSEMBLY

(71) Applicant: Lear Corporation, Southfield, MI (US)

(72) Inventors: Hyoun Lee, Rochester, MI (US); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/136,601

(22) Filed: Dec. 29, 2020

(65) Prior Publication Data

US 2022/0209456 A1 Jun. 30, 2022

(51) Int. Cl.
*H01R 12/77* (2011.01)
*H01R 13/52* (2006.01)
*H01R 12/59* (2011.01)

(52) U.S. Cl.
CPC ..... *H01R 13/5208* (2013.01); *H01R 12/592* (2013.01); *H01R 12/774* (2013.01)

(58) Field of Classification Search
CPC .. H01R 12/592; H01R 12/774; H01R 12/772; H01R 12/5202; H01R 12/771; H01R 13/5208; H01R 13/5202
See application file for complete search history.

(56) References Cited

U.S. PATENT DOCUMENTS 3,038,140 A * 6/1962 Haberland ..... H01R 12/82 439/329
6,064,003 A 5/2000 Moore et al.
7,063,560 B2 6/2006 Asao
7,354,308 B2 * 4/2008 Iwahori ..... H01R 13/5205 439/274
8,113,880 B2 * 2/2012 Cappe ..... H01R 13/5205 439/587
8,840,412 B2 9/2014 Ohyama et al.
9,203,179 B2 12/2015 Ohyama
9,508,465 B2 11/2016 Miura et al.
2008/0045066 A1 2/2008 Peter et al.

OTHER PUBLICATIONS

PAVE technology Company, Pressure and Vacuum Electronics, "Hermetic Electrical and Fiber Optic PAVE-Seals® Standard and Custom Design Guide", PAVEtechnologyCo.com.

* cited by examiner

*Primary Examiner* — Vanessa Girardi
(74) *Attorney, Agent, or Firm* — MacMillan, Sobanski & Todd, LLC

(57) ABSTRACT

A sealed electrical connector assembly includes a connector housing having a first end, a second end, and an opening that extends from the first end to the second end. The opening defines an inner surface of the connector housing. A seal is disposed within the opening of the connector housing and includes a first end, a second end, an outer surface, and a slot that extends from the first end of the seal to the second end of the seal. The outer surface of the seal is in sealing engagement with the inner surface of the connector housing, and the slot defines an inner surface of the seal. A flat flexible conductor disposed within the slot of the seal and includes a plurality of electrically conductive traces and an outer surface. The outer surface of the flat flexible conductor is in sealing engagement with the inner surface of the seal.

20 Claims, 10 Drawing Sheets

SEALS FOR A FLAT FLEXIBLE CONDUCTOR IN AN ELECTRICAL CONNECTOR ASSEMBLY

BACKGROUND OF THE INVENTION

This invention relates in general to electrical connector assemblies that facilitate mechanical and electrical connections between two electrically conductive structures. In particular, this invention relates to an improved structure for such an electrical connector assembly that can quickly and easily be secured to an electrically conductive structure, such as a flat flexible conductor having multiple electrically conductive traces, in a sealed manner so as to positively prevent the entry of contaminants therein.

Many electrical systems are known in the art that include one or more electrically operated devices. For example, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. In many instances, electrical connector assemblies are provided on the electrical conductors for facilitating the installation, service, and removal of these electrically operated devices to and from the electrical system.

A typical electrical connector assembly includes an outer housing (which is usually formed from an electrically non-conductive material) and an inner electrical terminal (which is usually formed from an electrically conductive material) that is supported within the housing. The housing usually has first and second openings extending therethrough, and the electrical terminal is supported within the housing adjacent to those first and second openings. The first opening facilitates the passage of a first electrically conductive structure through the housing into engagement with the electrical terminal supported therein. The second opening facilitates the passage of a second electrically conductive structure through the housing into engagement with the electrical terminal supported therein.

In many instances, the electrical connector assemblies are used in environments that are or may be exposed to undesirable contaminants, such as dirt, water, and the like. Although known electrical connector assemblies provide some protection against the entry of such contaminants within the housings thereof, it would be desirable to provide an improved structure for an electrical connector assembly that can quickly and easily be secured to an electrically conductive structure, such as a flat flexible conductor having multiple electrically conductive traces, in a sealed manner so as to positively prevent the entry of contaminants therein.

SUMMARY OF THE INVENTION

This invention relates to a sealed electrical connector assembly that includes a connector housing having a first end, a second end, and an opening that extends from the first end of the connector housing to the second end of the connector housing. The opening defines an inner surface of the connector housing. A seal is disposed within the opening of the connector housing and includes a first end, a second end, an outer surface, and a slot that extends from the first end of the seal to the second end of the seal. The outer surface of the seal is in sealing engagement with the inner surface of the connector housing, and the slot defines an inner surface of the seal. A flat flexible conductor disposed within the slot of the seal and includes a plurality of electrically conductive traces and an outer surface. The outer surface of the flat flexible conductor is in sealing engagement with the inner surface of the seal.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
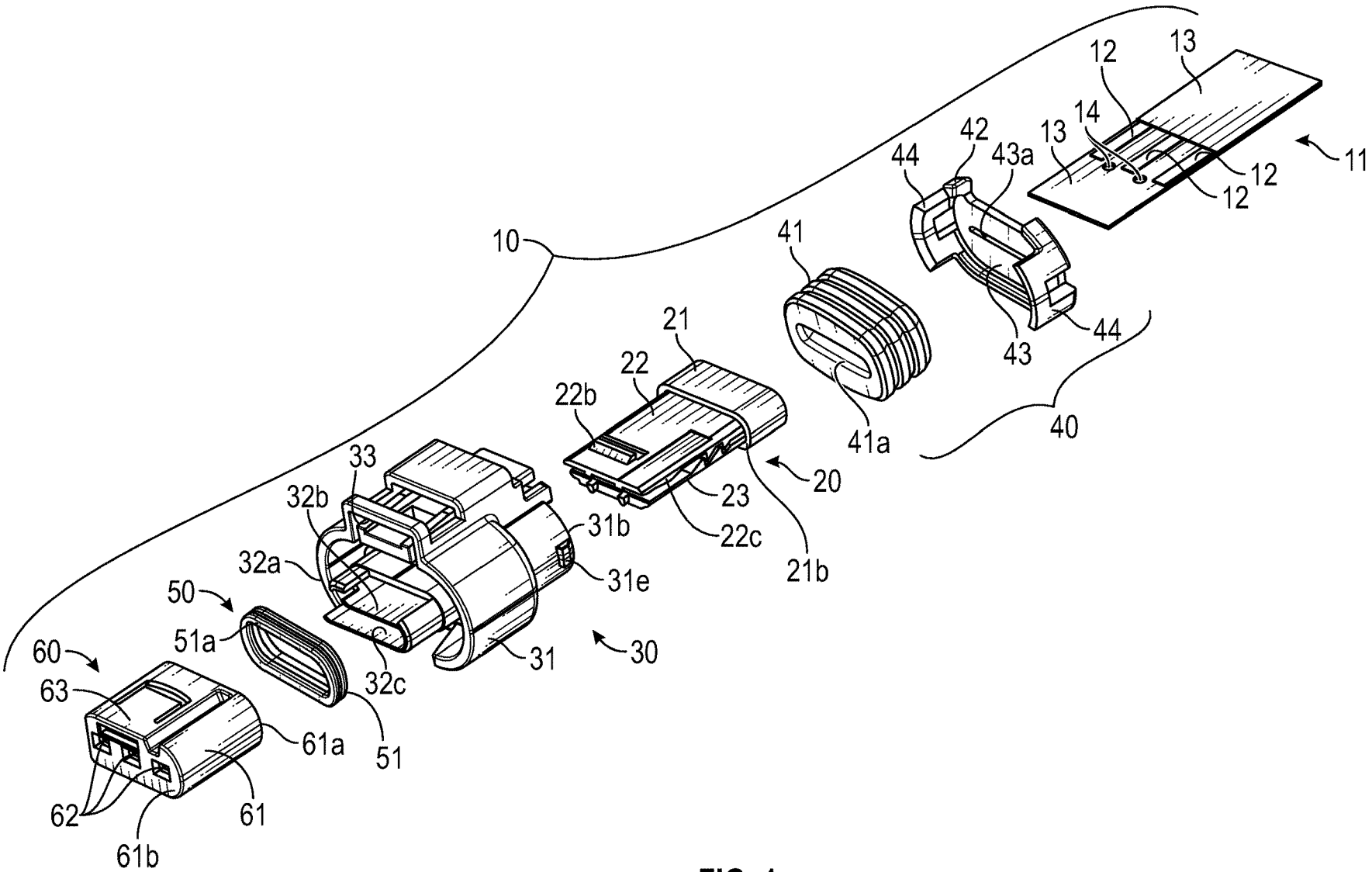
FIG. 1 is an exploded perspective view of a first embodiment of a sealed electrical connector assembly including a portion of an electrically conductive structure, a wire contact wedge, a connector housing, a front cover, and first and second seals in accordance with this invention.

Referring now to the drawings, there is illustrated in FIG. 1 a first embodiment of an electrical connector assembly, indicated generally at 10, in accordance with this invention. The first embodiment of the electrical connector assembly 10 includes an electrically conductive structure, indicated generally at 11. In the illustrated embodiment, the electrically conductive structure 11 is a flat flexible conductor having one or more electrically conductive traces 12 that are surrounded by an outer electrically non-conductive insulator 13. However, the electrically conductive structure 11 may have any other desired structure. As discussed above, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. The electrically conductive traces 12 of the electrically conductive structure 11 can be used for this purpose.

In the illustrated embodiment, the electrically conductive structure 11 includes three electrically conductive traces 12. However, the electrically conductive structure 11 may include a greater or lesser number of such electrically conductive traces 12 if desired. For a reason that will become apparent below, a portion of the electrically non-conductive insulator 13 is removed adjacent to an end of the electrically conductive structure 11 so as to expose the electrically conductive traces 12. Additionally, one or more openings 14 (two in the illustrated embodiment) extend through the illustrated electrically conductive structure 11. The purpose for the openings 14 will also be explained below. However, the openings 14 are optional and may, if desired, be omitted.

Figure 2:
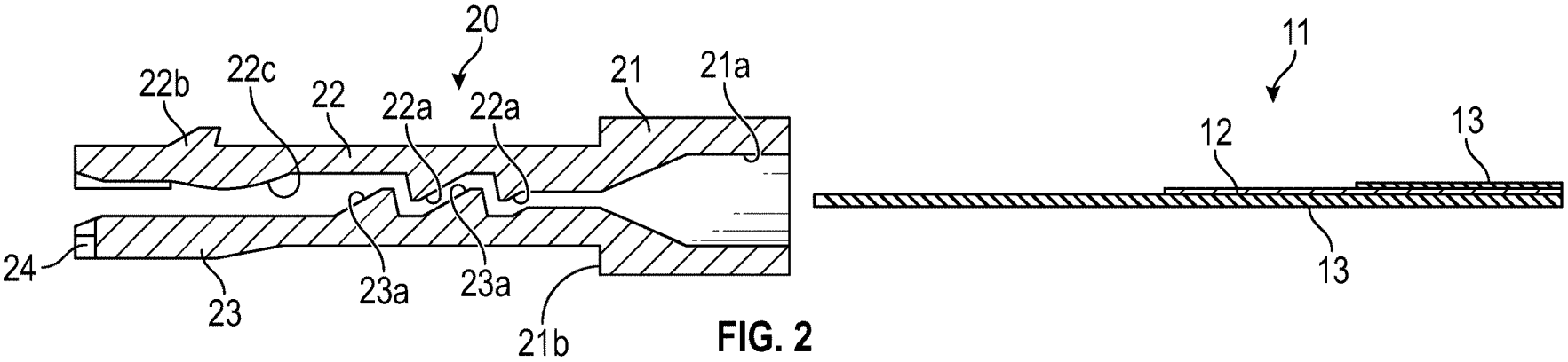
FIG. 2 is an exploded side sectional view of the electrically conductive structure and the wire contact wedge illustrated in FIG. 1.
Figure 3:
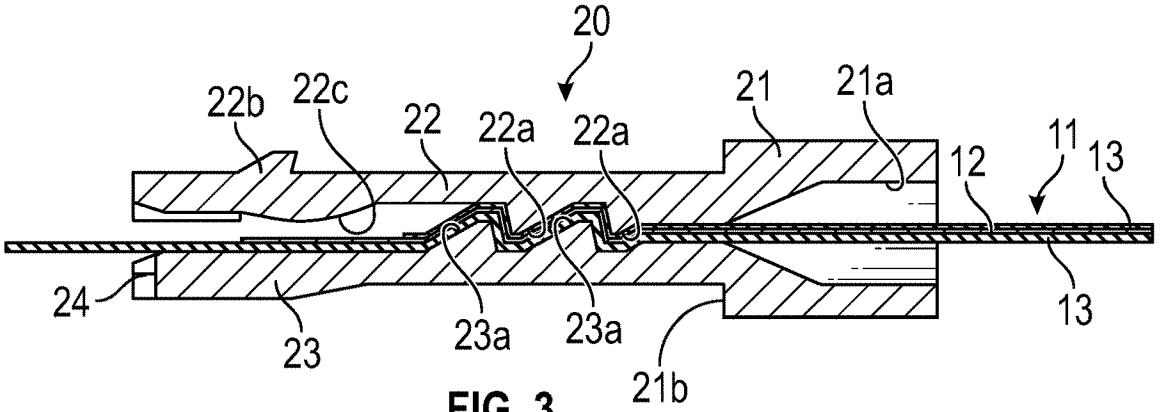
FIG. 3 is a side sectional view similar to FIG. 2 showing the electrically conductive structure after assembly with the wire contact wedge.
Figure 4:
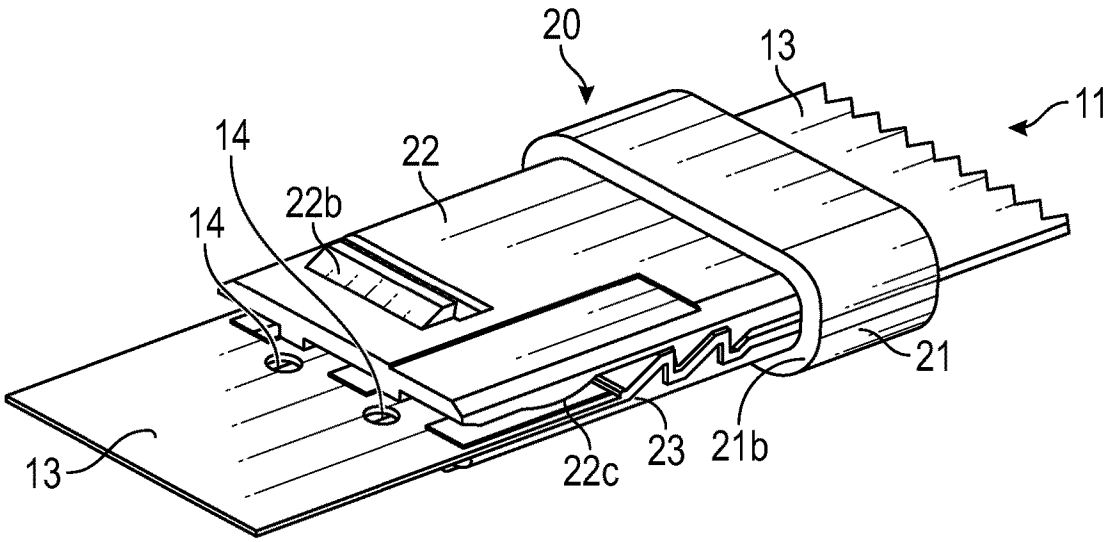
FIG. 4 is a perspective view of the assembly of the electrically conductive structure and the wire contact wedge illustrated in FIG. 3.

The first embodiment of the electrical connector assembly 10 of this invention also includes a wire contact wedge, indicated generally at 20. As best shown in FIGS. 2, 3, and 4, the wire contact wedge 20 includes a base 21 having an opening 21*a* that extends from a first axial end of the wire contact wedge 20 to a second axial end thereof. The base 21 also has an axially-facing abutment surface 21*b* provided thereon for a purpose that will be explained below. First and second wedge arms 22 and 23 extend axially from the axially-facing abutment surface 21*b* provided at the second axial end of the base 21 on opposite sides of the opening 21*a*. The inwardly facing surface of the first wedge arm 22 has a pair of projections 22*a* (best shown in FIG. 2) provided thereon. Similarly, the inwardly facing surface of the second wedge arm 23 has a pair of projections 23*a* (also best shown in FIG. 2) provided thereon. The illustrated projections 22*a* and 23*a* face toward one another and are axially offset from one another, although such is not required. Rather, any desired number of such projections 22*a* and 23*a* may be provided at any desired locations on the first and second wedge arms 22 and 23, respectively. Alternatively, the projections 22*a* and 23*a* may be omitted if desired.

As best shown in FIG. 2, the outwardly facing surface of the first wedge arm 22 has a retaining protrusion 22*b* provided thereon. Additionally, the inwardly facing surface of the first wedge arm 22 has a plurality of axially-extending embossments 22*c* (only one of which can be seen in FIG. 2) provided thereon. Preferably, the number of such axially-extending embossments 22*c* is the same as the number of traces 12 provided on the electrically conductive structure 11, although such is not required. Also, such axially-extending embossments 22*c* are also preferably located on the first wedge arm 22 so as to be respectively aligned with the traces 12 provided on the electrically conductive structure 11 as discussed below, although again such is not required. Finally, one or more positioning protrusions 24 (two in the illustrated embodiment) extend axially from an end of the second wedge arm 23. However, the protrusions 24 are optional and may, if desired, be omitted. The purposes of the outwardly facing retaining protrusion 22*b*, the embossments 22*c*, and the positioning protrusions 24 will be explained below.

FIGS. 2, 3, 4, and 5 illustrate how the electrically conductive structure 11 can be assembled with the wire contact wedge 20. Initially, as shown in FIG. 2, a leading end of the electrically conductive structure 11 is axially aligned with the first axial end of the base 21 of the wire contact wedge 20, adjacent to the opening 21*a* therethrough. Then, as shown in FIGS. 3 and 4, the leading end of the electrically conductive structure 11 is inserted through the opening 21*a* and moved axially through the base 21 of the wire contact wedge 20. During such axial movement of the electrically conductive structure 11 through the wire contact wedge 20, the first and second wedge arms 22 and 23 preferably move apart from one another to allow the electrically conductive structure 11 to pass through the area between the projections 22*a* and 23*a*. Thus, it is desirable (but not necessarily required) that the first and second wedge arms 22 and 23 be sufficiently flexible to allow this movement to occur.

Figure 5:
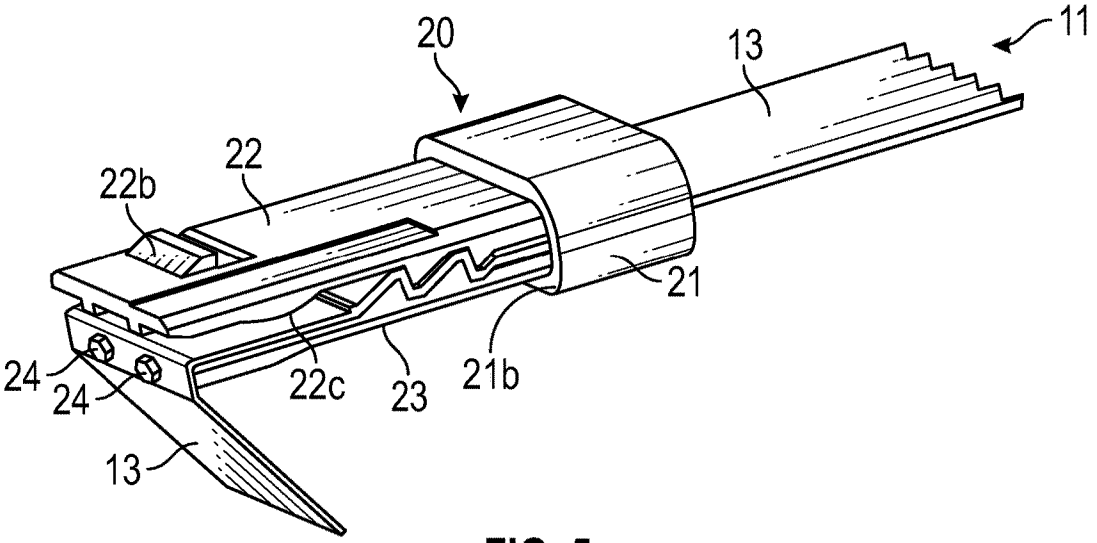
FIG. 5 is a perspective view similar to FIG. 4 showing the electrically conductive structure after being partially deformed about an end of the wire contact wedge.

Such axial movement is continued until the openings 14 extending through the electrically conductive structure 11 are disposed adjacent to the protrusions 24 provided on the axial end of the second wedge arm 23 of the wire contact wedge 20. Lastly, as shown in FIG. 5, the end of the electrically conductive structure 11 is deformed such that the openings 14 extending through the electrically conductive structure 11 are respectively disposed about the protrusions 24 provided on the axial end of the second wedge arm 23 of the wire contact wedge 20. As a result, the electrically conductive structure 11 is positively positioned relative to the wire contact wedge 20 to prevent relative axial movement from occurring therebetween.

The first embodiment of the electrical connector assembly 10 of this invention additionally includes a connector housing, indicated generally at 30. As will be explained below, the connector housing 30 is adapted to receive and support the assembly of the wire contact wedge 20 and the electrically conductive structure 11 therein. To accomplish this, the illustrated connector housing 30 includes a body 31 having an opening 31*a* that extends axially from a first axial end 31*b* (the right end when viewing FIGS. 6, 7, and 8) to a second axial end 31*c* (the left end when viewing FIGS. 6, 7, and 8). In the illustrated embodiment, the portion of the opening 31*a* that is adjacent to the first axial end 31*b* of the body 31 is larger than the portion of the opening 31*a* that is adjacent to the second axial end 31*c* of the body 31, although such is not required. As a result, an axially-facing abutment surface 31*d* is defined within the opening 31*a* extending through the body 31. A pair of opposed retainers 31*e* (one of which is illustrated in each of FIGS. 1 and 6) is provided on the exterior of the connector housing 30, for a purpose that will be explained below.

Also, one or more supports 32*a* and 32*b* (two in the illustrated embodiment) extend axially away from the second axial end 31*c* of the body 31 of the connector housing 30, adjacent to the opening 31*a*. In the illustrated embodiment, an inwardly facing surface on the outer end of the support 32*b* has a recessed area 32*c* provided thereon. The supports 32*a* and 32*b* additionally define an axially extending sealing surface 32*d* and a radially extending sealing wall 32*e*. Lastly, a retaining aperture 33 is provided on the body 31 adjacent to the second axial end 31*c* thereof. The purposes for the axially-facing abutment surface 31*d*, the supports 32*a* and 32*b*, the recessed area 32*c*, the axially extending sealing surface 32*d*, the radially extending sealing wall 32*e*, and retaining aperture 33 will also be explained below.

The first embodiment of the electrical connector assembly 10 of this invention further includes a first seal, indicated generally at 40. As will be explained below, the first seal 40 is adapted to provide a fluid-tight seal between the electrically conductive structure 11 and the connector housing 30. To accomplish this, the illustrated first seal 40 includes a unitary (i.e., formed from a single piece of material) body 41 having an opening 41*a* that extends axially therethrough. As shown in the illustrated embodiment, an inner surface of the body 41 defined by the opening 41*a* has approximately the same width and height as the width and height of the electronically conductive structure 11, although such is not required. As also shown in the illustrated embodiment, both an outer surface of the body 41 and the inner surface thereof are formed having undulating shapes, although again such as not required. The body 41 of the first seal 40 is preferably formed from an elastomeric material, such as silicon, although any desired material may be used.

The first seal 40 also includes a retainer 42 having an end portion 43. In the illustrated embodiment, the end portion 43 of the retainer 42 has the same general shape as the first seal 40, although such is not required. A slot 43*a* extends through the end portion 43 of the retainer 42. In the illustrated embodiment, the slot 43*a* has approximately the same width and height as the width and height of the electronically conductive structure 11, although such is not required. Lastly, a pair of arm portions 44 extend generally axially from the end portion 43 of the retainer 42. The purposes for the end portion 43, the slot 43*a*, and the arm portions 44 will be explained below. The retainer 42 of the first seal 40 is preferably formed from a relatively rigid material, such as plastic, although any desired material may be used.

Figure 6:
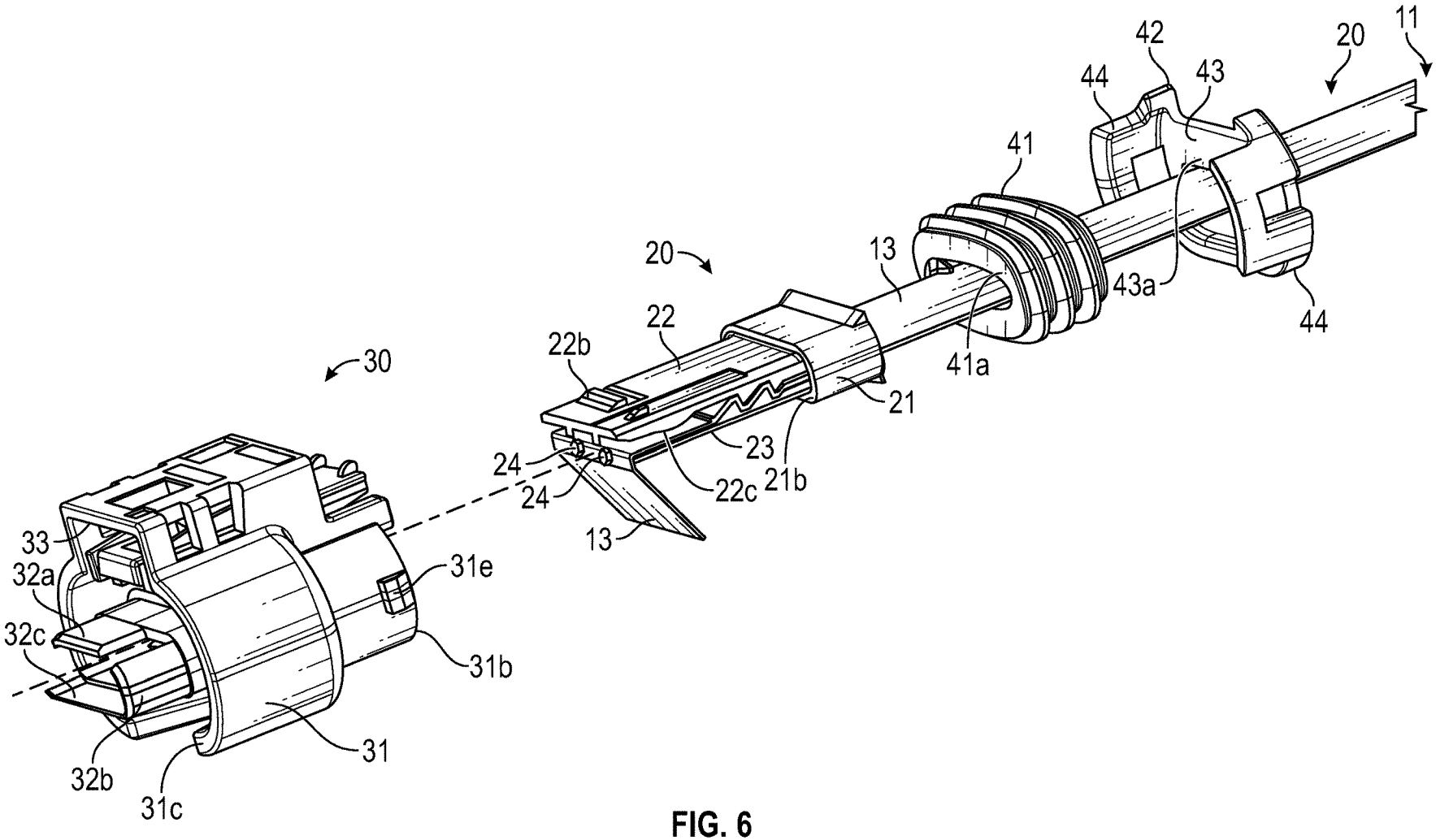
FIG. 6 is an exploded perspective view of the assembly of the electrically conductive structure and the wire contact wedge illustrated in FIG. 5 shown prior to assembly with the first seal and the connector housing illustrated in FIG. 1.
Figure 7:
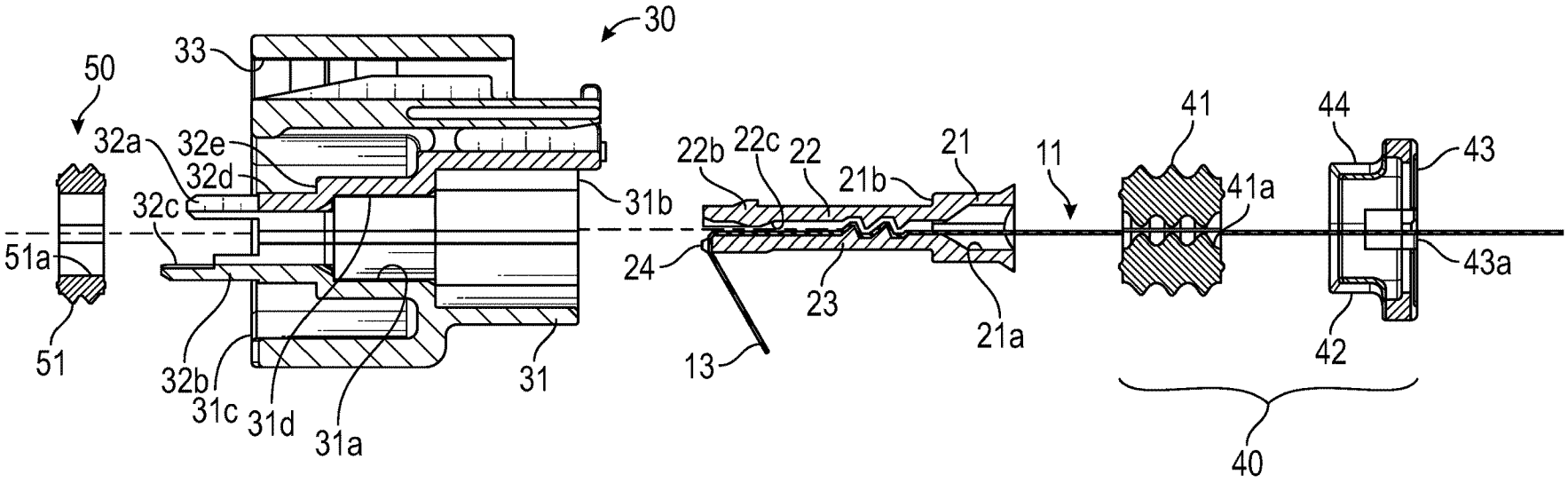
FIG. 7 is an exploded side sectional view of the assembly of the electrically conductive structure and the wire contact wedge, the first seal, and the connector housing illustrated in FIG. 6, together with the second seal illustrated in FIG. 1.
Figure 8:
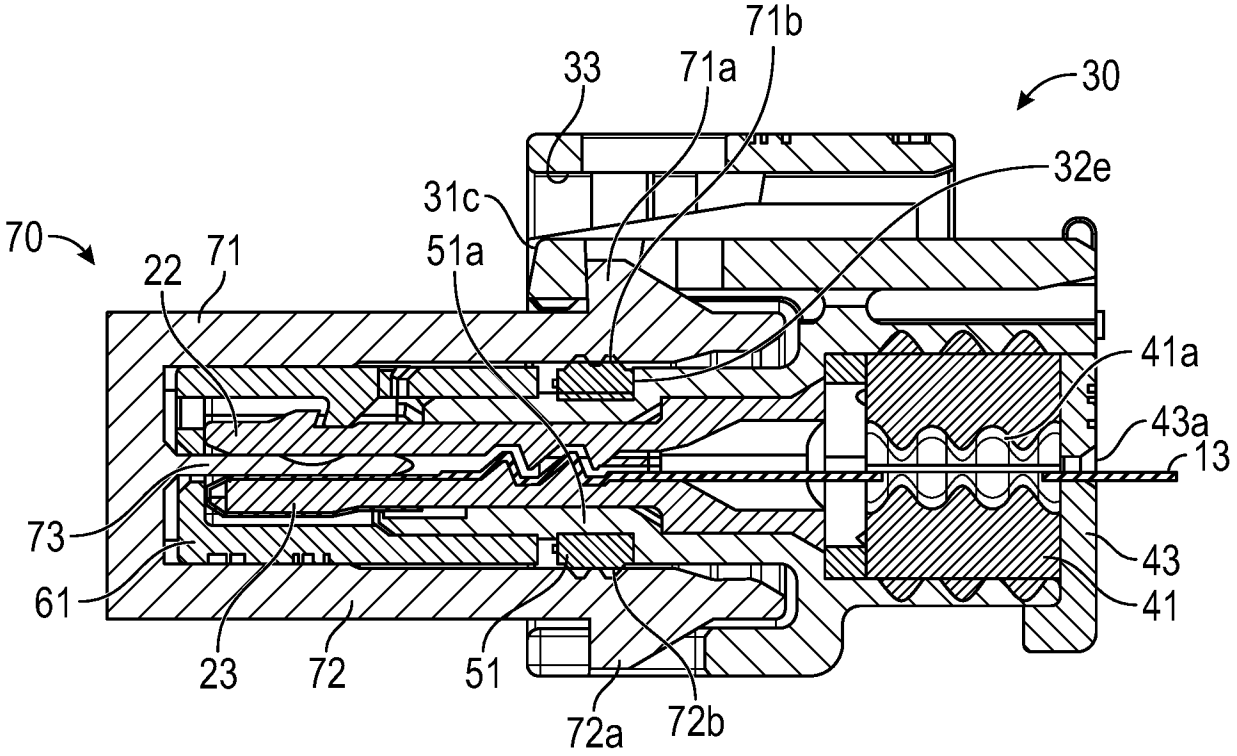
FIG. 8 is a side sectional view showing the assembly of the electrically conductive structure, the wire contact wedge, the first and second seals, and the connector housing illustrated in FIG. 7 after assembly to form the first embodiment of the electrical connector assembly.

FIGS. 6, 7, and 8 illustrate how the assembly of the wire contact wedge 20 and the electrically conductive structure 11 can be assembled with the connector housing 30 and the first seal 40. Initially, as shown in FIGS. 6 and 7, the body 41 of the first seal 40 can be assembled onto the electrically conductive structure 11 by aligning the opening 40*a* with an opposite end of the electrically conductive structure 11, and then moving the body 41 axially along the electronically conductive structure 11 until the body 41 is located adjacent to the wire contact wedge 20. Similarly, the retainer 42 of the first seal 40 can be assembled onto the electrically conductive structure 11 by aligning the slot 43*a* with the opposite end of the electrically conductive structure 11, and then moving the retainer axially along the electrically conductive structure 11 until the retainer 43 is located adjacent to the body 41, as shown in FIGS. 6 and 7. If desired, the assembly of the electrically conductive structure 11, the wire contact wedge 20, the connector housing 30, and the first seal 40 illustrated in FIGS. 6 and 7 may be performed in the reverse order as described above, namely, by initially installing the retainer 42, then the body 41, and then wire contact wedge 20 on the electrically conductive structure 11.

Next, the assembly of the wire contact wedge 20, the first seal 40, and the electrically conductive structure 11 is axially aligned with the first axial end 31*b* of the connector housing 30, adjacent to the first end of the opening 31*a* therethrough. Then, as shown in FIG. 8, the assembly of the wire contact wedge 20, the first seal 40, and the electrically conductive structure 11 is inserted through the opening 31*a* and moved axially through the body 31 of the connector housing 30 (from right to left when viewing FIG. 8). Such axial movement is continued until the abutment surface 21*b* provided on the base 21 of the wire contact wedge 20 engages the abutment surface 31*d* provided within the body 31 of the contact housing 30, as shown in FIG. 8. As a result, further axial movement of the assembly of the contact wedge 20 and the electrically conductive structure 11 is prevented. In this orientation, the wedge arms 22 and 23 extend between and are supported by the supports 32*a* and 32*b* extending from the second end 31*c* of the body 31 of the connector housing 30 adjacent to the opening 31*a*. At the same time, a portion of the end of the electrically conductive structure 11 is received within the recessed area 32*c* provided on the inwardly facing surface of the support 32*b* of the body 31. As a result, the end of the electrically conductive structure 11 is positively positioned relative to the connector housing 30.

At the same time, or thereafter, the body 41 of the first seal 40 is moved axially within the first end 31*b* of the connector housing 30. Preferably, the body 41 of the first seal 40 is slightly larger in size than the first end 31*b* of the connector housing 30. As a result, the outer undulating surface of the body 41 of the first seal 40 is compressed against the inner surface of the first end 31*b* of the connector housing 30, and the inner undulating surface of the body 41 of the first seal 40 is compressed against the outer surface of the electrically conductive structure 11, as shown in FIG. 8. Thus, the body 41 of the first seal 40 positively prevents the entry of contaminants through the first end 31*b* into the connector housing 30. Lastly, the retainer 42 of the first seal 40 is moved axially adjacent to the first end 31*b* of the connector housing 30 such that the arm portions 44 of the retainer 40 respectively engage the retainers 31*e* provided on the connector housing 30. As a result, the retainer 42 positively retains, and protectively covers, the body 41 of the first seal 40 on the connector housing 30.

If desired, a second seal 50 may be provided to positively prevent the entry of contaminants through the second end 31*c* into the connector housing 30. As shown in FIGS. 7 and 8, the second seal 50 includes an annular body 51 having an opening 51*a* that extends axially therethrough. An inner surface of the body 51 (which is defined by the opening 51*a*) preferably has a size that is slightly smaller than a size defined by an outer surface of the axially extending sealing surface 32*d* on the supports 32*a* and 32*b*. As also shown in FIGS. 7 and 8, an outer surface of the illustrated body 51 is formed having an undulating shape, although such as not required. The body 51 of the second seal 50 is preferably formed from an elastomeric material, such as silicon, although any desired material may be used.

FIGS. 7 and 8 illustrate how the second seal 50 can be assembled with the connector housing 30. Initially, as shown in FIG. 7, the inner surface 51*a* of the body 51 of the second seal 50 can be axially aligned with the axially extending sealing surface 32*d* on the supports 32*a* and 32*b* provided on the body 31 of the connector housing 30. Then, as shown in FIG. 8, the inner surface 51*a* of the body 51 of the second seal 50 can be moved axially about the axially extending sealing surface 32*d* on the supports 32*a* and 32*b*. As mentioned above, the inner surface 51*a* of the body 51 is preferably is slightly smaller than the outer surface of the axially extending sealing surface 32*d* on the supports 32*a* and 32*b*. As a result, the inner surface 51*a* of the body 51 is compressed against the outer surface of the axially extending sealing surface 32*d* on the supports 32*a* and 32*b*, as shown in FIG. 8. The size of the inner surface 51*a* of the body 51 can be selected to attain a desired amount of compression of the second seal 50 against the axially extending sealing surface 32*d*. Such axial movement of the second seal 50 is continued until the leading end thereof abuts the radially extending sealing wall 32*e*, as also shown in FIG. 8.

The first embodiment of the electrical connector assembly 10 of this invention includes a front cover, indicated generally at 60, that is adapted to be received within and supported on the assembly of the connector housing 30, the wire contact wedge 20, the first and second seals 40 and 50, and the electrically conductive structure 11. The illustrated front cover 60 includes a hollow body 61 that extends axially from an opened axial end 61*a* axial to a closed end 61*b*. One or more openings 62 extend generally axially through the closed axial end 61*b* of the hollow body 61 to the interior thereof. In the illustrated embodiment, three of such openings 62 extend through the closed end 61*b* of the hollow body 61. Preferably, the number of such openings 62 is the same as the number of traces 12 provided on the electrically conductive structure 11, although such is not required. Also, it is preferable that each of the openings 62 is axially aligned with a respective one of the traces 12, although again such is not required. Lastly, a flexible retaining arm 63 is formed integrally with or otherwise provided on the hollow body 61 of the front cover 60. The purposes for the front cover 60, the openings 62, and the retaining arm 63 will be explained below.

As shown in FIG. 8, the front cover 60 can be assembled with the assembly of the connector housing 30, the wire contact wedge 20, the first and second seals 40 and 50, and the electrically conductive structure 11. Initially, the assembly of the connector housing 30, the wire contact wedge 20, the first and second seals 40 and 50, and the electrically conductive structure 11 is axially aligned with the body 61 of the front cover 60, adjacent to the opened axial end 61*a* thereof. Then, the body 61 of the front cover 60 is moved axially toward the second axial end 31*c* of the body 31 of the connector housing 30 such that the supports 32*a* and 32*b* of the body 31 move axially through the opened axial end 61*a* of the front cover 60 into the interior thereof. Such axial movement continues until the opened axial end 61*a* of the front cover 60 abuts an axially facing portion of the connector housing 30, such as adjacent to the axially extending sealing surface 32*d* as shown in FIG. 8.

When the front cover 60 is positioned in this orientation relative to the connector housing 30, an inwardly extending portion of the retaining arm 63 is disposed adjacent to the retaining protrusion 22*b* provided on the outer surface of the first wedge arm 22 of the wire contact wedge 20. The retaining arm 63 cooperates with the retaining protrusion 22*b* such that the front cover 60 is positively retained on the assembly of the connector housing 30, the wire contact wedge 20, the first and second seals 40 and 50, and the electrically conductive structure 11. However, the front cover 60 may be removed from the assembly of the connector housing 30, the wire contact wedge 20, the first and second seals 40 and 50, and the electrically conductive structure 11 by manually moving the retaining arm 63 outwardly out of engagement with the retaining protrusion 22*b* and pulling the front cover 60 axially in the opposite direction away from the second axial end 31*c* of the body 31 of the connector housing 30.

FIG. 8 also illustrates a second electrical connector assembly 70 that is connected to the first embodiment of the electrical connector assembly 10 of this invention. The illustrated second electrical connector assembly 70 is conventional in the art and includes first and second axially-extending support arms 71 and 72. The first and second axially-extending support arms 71 and 72 have respective retaining portions 71*a* and 72*a* provided thereon. The first and second axially-extending support arms 71 and 72 also have respective sealing surfaces 71*b* and 72*b* provided thereon. The second electrical connector assembly 70 also includes one or more axially-extending terminal pins 73 provided thereon. Preferably, the number of such axially-extending terminal pins 73 is the same as the number of traces 12 provided on the electrically conductive structure 11, although such is not required. Also, such axially-extending terminal pins 73 are preferably respectively aligned with the traces 12 provided on the electrically conductive structure 11, although again such is not required.

The second electrical conductor assembly 70 can be inserted within and supported on the first embodiment of the electrical connector assembly 10 of this invention by initially aligning the second electrical connector assembly 70 with the first embodiment of the electrical connector assembly 10 and moving it axially thereabout, as shown in FIG. 8. When so moved, the support arms 71 and 72 of the second electrical connector assembly 70 are inserted within the interior of the body 31 of the connector housing 30 such that the retaining portions 71*a* and 72*a* of the retaining arms 71 and 72 engage respective portions of the body 31 of the connector housing 30. As such, the second electrical connector assembly 70 is releasably retained on the first embodiment of the electrical connector assembly 10 of this invention. At the same time, each of the terminal pins 73 of the second electrical connector 70 is received between a portion of the electrical connector assembly 11 and a portion of the first wedge arm 22, as also shown in FIG. 8. In particular, each of the terminal pins 73 is engaged by an associated one of the embossments 22*c* provided on the first wedge arm 22. As a result, the terminal pin 73 is affirmatively urged into engagement with the associated trace 12 provided on the electrically conductive structure 11 so as to provide a good electrical connection therebetween.

When the second electrical conductor assembly 70 is inserted within and supported on the first embodiment of the electrical connector assembly 10 of this invention in this manner, the sealing surfaces 71*b* and 72*b* provided on the first and second axially-extending support arms 71 and 72 extend about the undulating outer surface of the body 51 of the second seal 50, as shown in FIG. 8. Preferably, the outer surface of the body 51 is slightly larger than the sealing surfaces 71*b* and 72*b* provided on the first and second axially-extending support arms 71 and 72. As a result, the outer surface of the body 51 is compressed against the sealing surfaces 71*b* and 72*b*, as shown in FIG. 8. The size of body 51 can be selected to attain a desired amount of compression of the second seal 50 against the sealing surfaces 71*b* and 72*b*. Thus, the body 51 of the second seal 50 cooperate with one another to positively prevent the entry of contaminants through the second end 31*c* into the connector housing 30.

Figure 9:
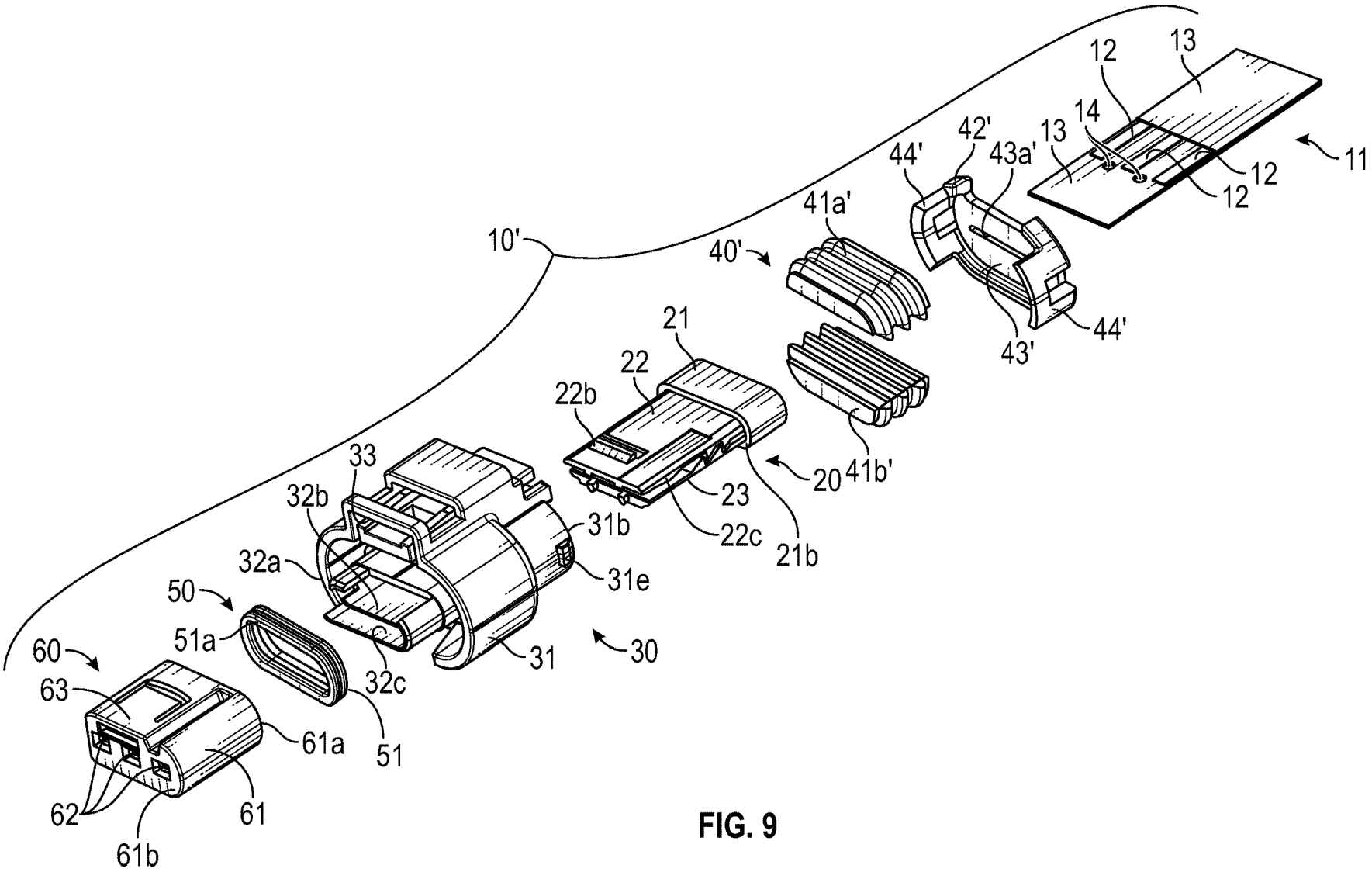
FIG. 9 is an exploded perspective view of a second embodiment of an electrical connector assembly including a portion of an electrically conductive structure, a wire contact wedge, a connector housing, a front cover, and first and second seals in accordance with this invention.
Figure 10:
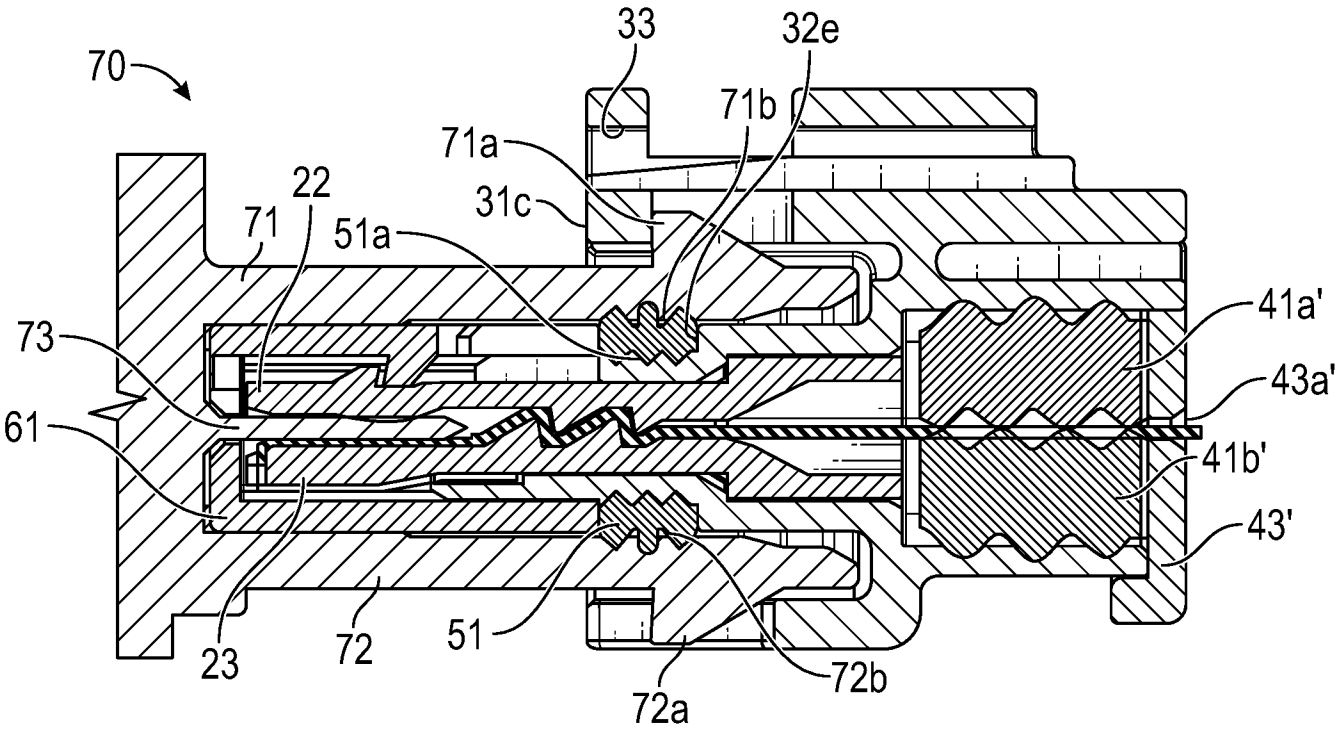
FIG. 10 is a side sectional view showing the assembly of the electrically conductive structure, the wire contact wedge, the first and second seals, and the connector housing illustrated in FIG. 11 after assembly to form the second embodiment of the electrical connector assembly.

FIGS. 9 and 10 illustrate a second embodiment of an electrical connector assembly, indicated generally at 10', in accordance with this invention. The second embodiment of the electrical connector assembly 10' is, in large measure, identical to the first embodiment of the electrical connector assembly 10, and like reference numbers are used to illustrate similar components. In the second embodiment of the electrical connector assembly 10', however, an alternative first seal 40' includes a split body formed from two body portions 41*a*' and 41*b*'. The two body portions 41*a*' and 41*b*' have respective inner surfaces that are disposed adjacent to one another and function in the same manner as the opening

41*a* that extends axially through the unitary body 41 of the embodiment illustrated in FIGS. 1 through 8. As shown in FIGS. 9 and 10, the outer surfaces of the two body portions 41*a*' and 41*b*', as well is the adjacent inner surfaces thereof, are formed having undulating shapes, although such as not required. Each of the two body portions 41*a*' and 41*b*' of the first seal 40' is preferably formed from an elastomeric material, such as silicon, although any desired material may be used. The first seal 40' also includes a retainer 42' having an end portion 43', a slot 43*a*', and a pair of arm portions 44', all for the same purposes as described above.

Figure 11:
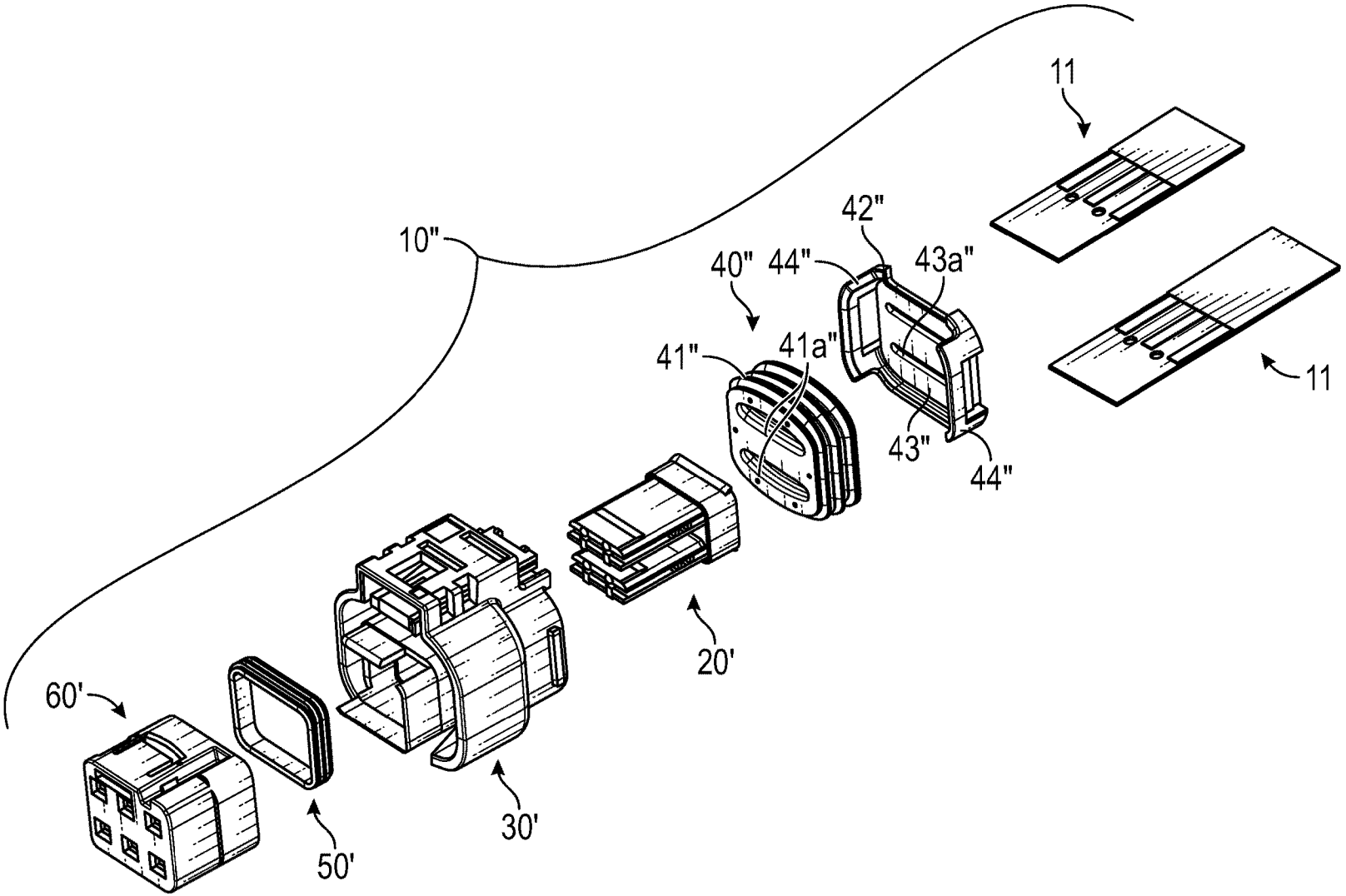
FIG. 11 is an exploded perspective view of a third embodiment of an electrical connector assembly including portions of two electrically conductive structures, a wire contact wedge, a connector housing, a front cover, and first and second seals in accordance with this invention.
Figure 13:
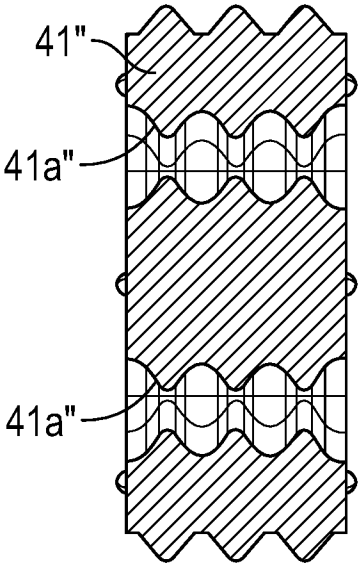
FIG. 13 is a side sectional view of the first seal illustrated in FIGS. 11 and 12.
Figure 12:
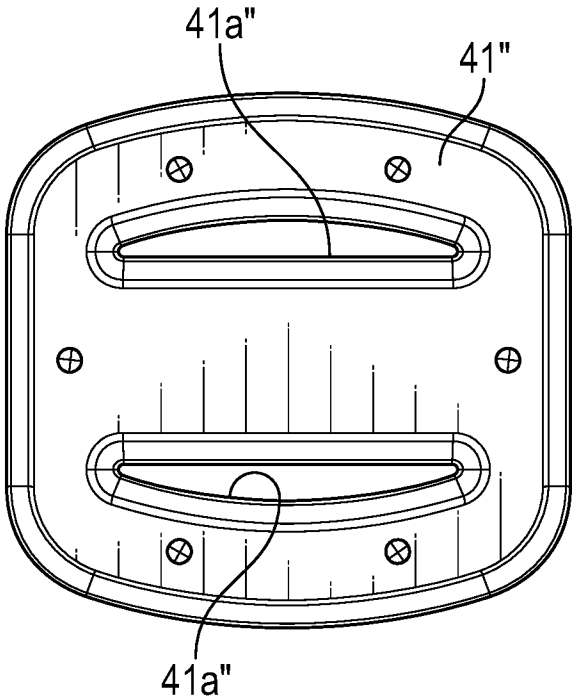
FIG. 12 is an end elevational view of the first seal illustrated in FIG. 11.

FIGS. 11, 12, and 13 illustrate a third embodiment of an electrical connector assembly, indicated generally at 10", in accordance with this invention. The third embodiment of the electrical connector assembly 10" is, in large measure, identical to the first embodiment of the electrical connector assembly 10, and like reference numbers are used to illustrate similar components. In the third embodiment of the electrical connector assembly 10", however, a plurality (two in the illustrated embodiment) of electrically conductive structures 11 are provided. To accommodate these plural electrically conductive structures 11, a further alternative first seal 40" is provided that includes a body portion 41" having a corresponding plurality of openings 41*a*" extending axially therethrough. Each of the openings 41*a*" may have the same structure and function in the same manner as the opening 41*a* that extends axially through the unitary body 41 of the embodiment illustrated in FIGS. 1 through 8. As shown in FIGS. 11, 12, and 13, the outer surface of the body portion 41", as well is the inner surfaces of each of the openings 41*a*", are formed having undulating shapes, although such as not required. The body portion 41" of the first seal 40" is preferably formed from an elastomeric material, such as silicon, although any desired material may be used. The first seal 40" also includes a retainer 42" having an end portion 43", a pair of slots 43*a*", and a pair of arm portions 44", all for the same purposes as described above.

As shown in FIG. 11, the structures of the wire contact wedge 20", the connector housing 30", the second seal 50", and the front cover 60" may be modified in size and/or shape to accommodate the two electrically conductive structures 11. However, the functions of the wire contact wedge 20", the connector housing 30", the second seal 50", and the front cover 60" are the same as described above in connection with FIGS. 1 through 8.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A sealed electrical connector assembly comprising:

a connector housing including a first end, a second end, and an opening that extends from the first end of the connector housing to the second end of the connector housing, wherein the opening defines an inner surface of the connector housing;

a wire contact wedge supported within the connector housing and including a base having a wedge arm extending therefrom;

a seal disposed within the first end of the connector housing and including a body having a first end, a second end, an outer surface, and a slot that extends through the body of the seal from the first end of the body of the seal to the second end of the body of the seal, wherein the outer surface of the body of the seal is in sealing engagement with the inner surface of the connector housing, and wherein the slot defines an inner surface of the body of the seal; and a flat flexible conductor having a first portion that is supported on the wedge arm of the wire contact wedge and a second portion that extends through the slot through the body of the seal, the flat flexible conductor including a plurality of electrically conductive traces and an outer surface, wherein the outer surface of the flat flexible conductor is in sealing engagement with the inner surface of the body of the seal.

2. The sealed electrical connector assembly defined in claim 1 wherein the outer surface of the body of the seal is formed having an undulating shape.

3. The sealed electrical connector assembly defined in claim 1 wherein the inner surface of the body of the seal is formed having an undulating shape.

4. The sealed electrical connector assembly defined in claim 1 wherein the body of the seal is a unitary body.

5. The sealed electrical connector assembly defined in claim 1 wherein the body portion of the seal has two slots that each extend from the first end of the body of the seal to the second end of the body of the seal and that define perspective inner surfaces of the body of the seal, and wherein a flat flexible conductor disposed within each of the two slots and includes a plurality of electrically conductive traces and an outer surface, wherein the outer surfaces of each of the flat flexible conductors are in sealing engagement with the respective inner surfaces of the body of the seal.

6. The sealed electrical connector assembly defined in claim 1 wherein the seal further includes a retainer having an end portion and an arm portion, wherein the end portion of the retainer includes a slot through which the flat flexible conductor extends, and wherein the arm portion of the retainer engages the connector housing to retain the seal thereon.

7. The sealed electrical connector assembly defined in claim 6 wherein the retainer includes two arm portions, wherein each of the arm portions of the retainer engages the connector housing to retain the seal thereon.

8. The sealed electrical connector assembly defined in claim 1 wherein the body of the seal is a split body formed from two body portions having respective inner surfaces that are disposed adjacent to one another and define the slot that extends from the first end of the body of the seal to the second end of the body of the seal.

9. The sealed electrical connector assembly defined in claim 8 wherein each of the inner surfaces of the body portions is formed having an undulating shape.

10. The sealed electrical connector assembly defined in claim 1 further including a second seal disposed within the second end of the connector housing, wherein the second seal includes a body having an opening extending therethrough that defines an inner surface of the body.

11. The sealed electrical connector assembly defined in claim 10 wherein the second end of the connector housing includes a support surface, and wherein the inner surface of the body of the second seal sealingly engages the support surface on the second end of the connector housing.

12. The sealed electrical connector assembly defined in claim 10 wherein the second end of the connector housing includes an axially extending sealing surface and a radially extending sealing wall, and wherein the body of the second seal sealingly engages both the axially extending sealing surface and the radially extending sealing wall.

13. A sealed electrical connector assembly comprising:

a connector housing including a first end, a second end, and an opening that extends from the first end of the connector housing to the second end of the connector housing, wherein the opening defines an inner surface of the connector housing;

a wire contact wedge supported within the connector housing;

a seal disposed within the first end of the connector housing and including a body having a first end, a second end, an outer surface, and a slot that extends through the body of the seal from the first end of the body of the seal to the second end of the body of the seal, wherein the outer surface of the body of the seal is in sealing engagement with the inner surface of the connector housing, and wherein the slot defines an inner surface of the body of the seal; and a flat flexible conductor having a first portion that is supported on the wire contact wedge and a second portion that extends through the slot through the body of the seal, the flat flexible conductor including a plurality of electrically conductive traces and an outer surface, wherein:

the outer surface of the flat flexible conductor is in sealing engagement with the inner surface of the body of the seal, and wherein the wire contact wedge includes a base having an opening extending therethrough and first and second wedge arms that extend from the base and engage the flat flexible connector.

14. The sealed electrical connector assembly defined in claim 13 wherein the seal further includes a retainer having an end portion and an arm portion, wherein the end portion of the retainer includes a slot through which the flat flexible conductor extends, and wherein the arm portion of the retainer engages the connector housing to retain the seal thereon.

15. The sealed electrical connector assembly defined in claim 13 further including a second seal disposed within the second end of the connector housing.

16. The sealed electrical connector assembly defined in claim 15 wherein the second seal includes a body having an opening extending therethrough that defines an inner surface of the body.

17. A sealed electrical connector assembly comprising:

a connector housing including a first end, a second end, and an opening that extends from the first end of the connector housing to the second end of the connector housing, wherein the opening defines an inner surface of the connector housing;

a wire contact wedge supported within the connector housing;

a seal disposed within the first end of the connector housing and including a body having a first end, a second end, an outer surface, and a slot that extends through the body of the seal from the first end of the body of the seal to the second end of the body of the seal, wherein the outer surface of the body of the seal is in sealing engagement with the inner surface of the connector housing, and wherein the slot defines an inner surface of the body of the seal; and a flat flexible conductor having a first portion that is supported on the wire contact wedge and a second portion that extends through the slot through the body of the seal, the flat flexible conductor including a plurality of electrically conductive traces and an outer surface, wherein:

the outer surface of the flat flexible conductor is in sealing engagement with the inner surface of the body of the seal, the wire contact wedge includes a base having an abutment surface and two wedge arms that extend from the base and engage the flat flexible connector, and the connector housing includes a body having an abutment surface that engages the abutment surface of the base of the wire contact wedge.

18. The sealed electrical connector assembly defined in claim 17 wherein the seal further includes a retainer having an end portion and an arm portion, wherein the end portion of the retainer includes a slot through which the flat flexible conductor extends, and wherein the arm portion of the retainer engages the connector housing to retain the seal thereon.

19. The sealed electrical connector assembly defined in claim 17 further including a second seal disposed within the second end of the connector housing.

20. The sealed electrical connector assembly defined in claim 19 wherein the second seal includes a body having an opening extending therethrough that defines an inner surface of the body.

* * * * *